United States Patent [19]

Darlington

[11] Patent Number: 4,986,250

[45] Date of Patent: Jan. 22, 1991

[54] COMPOUND BOW WITH ADJUSTABLE CABLE LENGTH

[76] Inventor: Rex F. Darlington, 3540 Darton Rd., Hale, Mich. 48739

[21] Appl. No.: 501,560

[22] Filed: Mar. 30, 1990

[51] Int. Cl.[5] ..... F41B 5/00

[52] U.S. Cl. ..... 124/25.6; 124/90

[58] Field of Search ..... 124/23.1, 24.1, 25.5, 124/25.6, 25, 25.7, 80, 86, 90

[56] References Cited

U.S. PATENT DOCUMENTS

| | | | |
|---|---|---|---|
| 4,241,715 | 12/1980 | Jennings | 124/25.6 |
| 4,401,097 | 8/1983 | Simonds et al. | 124/25.6 |
| 4,562,824 | 1/1986 | Jennings | 124/25.6 |
| 4,838,236 | 6/1989 | Kudlacek | 124/25.6 |

*Primary Examiner*—Randolph A. Reese
*Assistant Examiner*—Jeffrey L. Thompson
*Attorney, Agent, or Firm*—Barnes, Kisselle, Raisch, Choate, Whittemore & Hulbert

[57] ABSTRACT

A compound bow utilizes tension cables and bowstring cables acting on grooved cam pulley assemblies. The tension cables are not continuous to the bowstring cables but are individually anchored at each end. Looped ends of the bowstring cable are transfixed by a rigid cross pin which can be selectively lodged in one of a plurality of cross slots intersecting a diametrical groove in a side surface of a pulley. The bowstring is captured in a groove as it enters the pulley by a segment of a tension cable pulley.

3 Claims, 1 Drawing Sheet

COMPOUND BOW WITH ADJUSTABLE CABLE LENGTH

FIELD OF INVENTION

Compound bows with bowstring and tension cable cams having draw length adjustment.

BACKGROUND AND FEATURES OF THE INVENTION

In the designing of long bows utilizing the so-called compound action, the Allen patent, U.S. Pat. No. 3,486,495 (1969) was a precursor of many different pulley cam action bows. The compound bow had a main bowstring wrapping around a main pulley, eccentrically mounted, and tension cables anchored at respective bow limb ends and wrapping around a tension cable sheave adjacent the main pulley cam. One of the factors in the design of a bow is the draw length for the arrow. A person with short arms may desire a shorter draw length than a person with long arms. It can be generally stated that the longer the draw, the greater is the stored energy. Accordingly, many bow designers have directed their attention to a bow structure in which the draw length could be adjusted to suit a particular user. Also, it is an object of the invention to provide fine tuning of the cams or wheels as can be effected by bowstring length or cable length.

However, the main thrust of the present invention is a simple mechanical attachment cooperating with recesses in the pulley wheels to allow anchoring of the ends of a bowstring in the wheel with no need for special tools or devices. The proposed invention also eliminates the need for the tear drop connector between a bowstring and a separate cable end.

A recently issued U.S. patent to Kudlacek, U.S. Pat. No. 4,838,236 (1989) shows the use of multiple screw holes in a cam pulley to adjust a cable length in the same manner as shown in Nishioka, U.S. Pat. No. 3,989,026 (1976) where multiple anchor holes are provided in a handle mounted cable pulley. My copending application, Ser. No. 316,773, filed Feb. 28, 1989, now U.S. Pat. No. 4,926,832, shows one manner of attaching looped ends of a bowstring cable adjustable to a cam pulley.

In many compound bow designs the bowstring cable, sometimes called a working stretch, wraps over a main bow pulley sheave for a substantial part of the pulley circumference to allow the unwrap to occur when the arrow is drawn. In most cases the bowstring cable was then passed diametrically of the pulley cam set and led out to the sheaves of the tension cable pulley without interruption of the cable.

The invention in the present case lies in the interruption of the cable so that an end of the bowstring is directed from the circumference of the main bowstring sheave toward the interior of the sheave to terminate at an exposed area where it can be anchored. The tension cables are then not a continuation of the main working stretch but originate at free ends which can be anchored at one of a plurality of positions. As the bowstring, that is, the working stretch, is drawn and unwraps from the main sheave, the tension cable wraps up on the tension cable sheave. Basically, the bowstring attachment in the present invention is used to capture the respective ends of a bowstring to locate it securely on the eccentric wheels on anchor points on the wheels. No tools or mechanical devices are needed to attach the bowstring.

The basic concept may also be used for adjustment of bowstring length and tension cables by providing more than one anchor point on the eccentric wheel. U.S. Pat. No. 4,241,715 to Jennings illustrates one means of adjusting draw length. U.S. patent to Simmons U.S. Pat. No. 4,440,142 illustrates another means of adjustment in a bridle cable type of compound bow. With the present invention, the complexities of a bridle harness are eliminated.

The present invention is directed to an alternate design for ready attachment of a bowstring end to alternate position on a cam pulley. This is accomplished by providing a partial diametrical opening groove in a portion of the cam pulley with spaced slots formed transversely of the groove and intersecting the groove on each side. A stable loop is formed on the ends of the bowstring, for example, and short steel or brass pins, dimensioned to be received in the transverse slots, are passed through the loop end and then positioned in one of a plurality of slots. The bowstring is captured at the periphery of the pulley by a cable pulley segment applied to the main bowstring cam pulley.

Objects and features of the invention will be apparent in the following description and claims in which the principles of the invention are set forth together with details to enable a person skilled in the art to practice the invention, all in connection with the best mode recently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
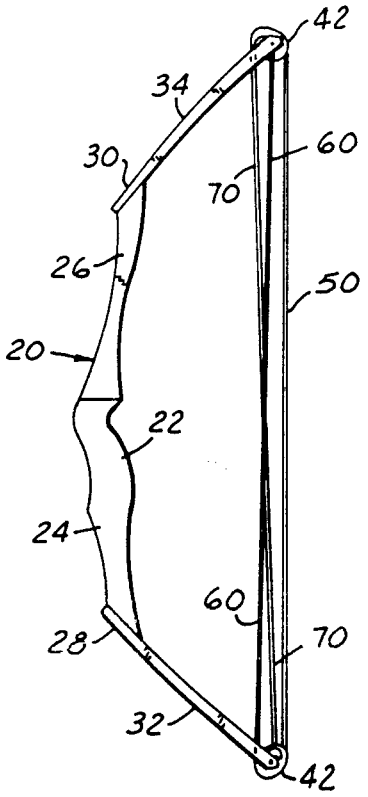
FIG. 1, a side view of a compound bow.

With reference to the drawings, a bow handle 20 has a shaped hand grip 22 and distal ends 24, 26 to which are attached root portions 28, 30 of flexing bow limbs 32 and 34. The distal ends of the bow limbs are bifurcate with an axle pin extending transversely through each to carry eccentric bowstring pulleys and tension cable cam pulleys in a manner common to many compound bows now in use. The Allen patent, U.S. Pat. No. 3,486,495 (1976), and the Darlington patent, U.S. Pat. No. 4,330,910 (1982), are examples. These are incorporated by reference as to the general structure and operation of compound bows. The referenced Darlington patent shows the bowstring wrapped around a main pulley sheave and passing diametrically to an outlet at the tension cable sheave.

Figure 2:
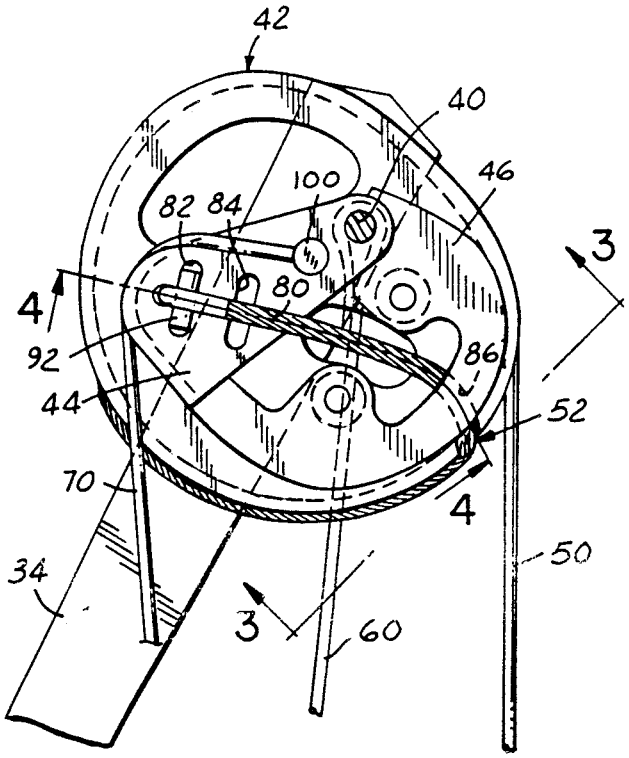
FIG. 2, an enlarged view of a cam wheel at the top end of the bow as viewed in FIG. 1.
Figure 4:
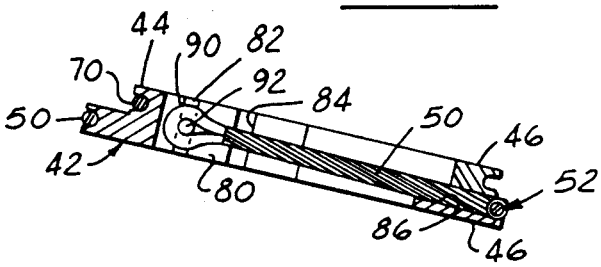
FIG. 4, sectional view on line 4—4 of FIG. 2.

In FIG. 2 of the drawings, an enlarged view of the top cable pulley cam assembly is illustrated on the bifurcate distal end of bow limb 34. An axle 40 rotatably mounts a bowstring pulley 42 and juxtaposed tension cable pulley 44. A bowstring cable 50 wraps in the grooved sheave of pulley 42 almost 360° and takes an inward turn at 52 across the pulley assembly. Tension cables 60 and 70 are provided in the usual manner.

The cable pulley is formed of the segment portion referenced as 44 and a separable segment 46 suitably bolted to the main pulley 42 to provide a continuing cable groove.

The eccentric cam wheels 42, 44, 46 can be molded, die cast or machined parts, and the tension cable segment is provided with a diametrical groove 80. Superimposed on grooves 80 are two transverse slots 82 and 84 open to groove 80. Under the tension cable pulley segment 46 is a curved groove 86 which receives the bowstring 50 as it leaves the groove in pulley 42 at 52 and moves diametrically toward the groove 80.

As illustrated in FIG. 2, the bowstring has a stable loop 90 and a pin 92 is passed through this loop and lodged in slot 82. The bowstring is thus captured by the segment 46 and anchored at the end on cross pin 92. By momentarily easing the tension on bowstring 50, the pin 92 may be shifted to the adjacent slot 84.

Figure 3:
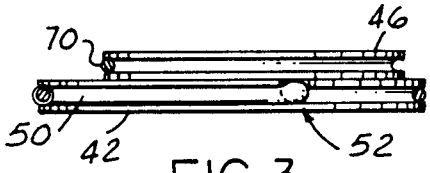
FIG. 3, a view of the cam on line 3—3 of FIG. 2.

A tension cable 60 is anchored on axle 40 by a looped end. This cable stretches to the lower end of the bow to a tension cable pulley. Similarly, cable 70 anchored at the lower axle extends to the tension cable pulleys 44, 46 and is anchored by a cross plug 100. FIG. 3 illustrates a view of the composite pulleys taken on line 3—3 of FIG. 2. A sectional view on line 4—4 of FIG. 2 illustrates the respective cables 50 and 70 as well as the slot 80 and cross-slots 82,84.

Thus, as the bowstring is nocked and drawn, the bowstring will unwrap from pulley 42 while the tension cable 70 wraps into the groove on segments 44, 46. It will be seen that cable end treatment of cables 60 and 70 could be treated to the same adjustable end slots as the bowstring if desired.

What is claimed is:

1. A compound bow including a center handle section supporting upper and lower limbs having distal ends with attached, grooved, eccentric cam wheel assemblies mounted on a transverse axis, and bowstring and tension cables extending between said wheel assemblies, that improvement which comprises a bowstring having a permanent loop at each end, a diametrical groove formed in each said cam wheel assembly, a plurality of cross slots extending transversely to said groove and spaced along said groove, and a rigid pin transfixing the loop at each end of said bowstring, said pin having its ends lodged in the ends of a cross slot on either side of said groove to anchor an end of said bowstring, said bowstring being wrapped around a sheave on said cam wheel assembly and turned inwardly toward the center of the wheel to lodge in said groove.

2. A compound bow as defined in claim 1 in which a tension cable pulley is superimposed on a bowstring cam wheel to overlie a portion of said groove to capture said bowstring as it extends inwardly from said bowstring sheave.

3. A compound bow as defined in claim 1 in which each said cam wheel assembly includes a tension wheel formed of two segments, one segment having a portion of the diametrical groove and said cross slots formed in a facing surface, and the other segment being releasably attached to said one segment and overlying a portion of said groove to capture said bowstring as it extends inwardly from said bowstring sheave.

* * * * *